US009291961B1

(12) United States Patent
Kawashima

(10) Patent No.: US 9,291,961 B1
(45) Date of Patent: Mar. 22, 2016

(54) FIXING APPARATUS AND IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventor: Yuki Kawashima, Tagata Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/602,089

(22) Filed: Jan. 21, 2015

(51) Int. Cl.
*G03G 15/20* (2006.01)

(52) U.S. Cl.
CPC ..... *G03G 15/2039* (2013.01)

(58) Field of Classification Search
CPC ..... G03G 15/2071; G03G 15/2035; G03G 15/2032; G03G 15/2067; G03G 15/205
See application file for complete search history.

(56) References Cited

U.S. PATENT DOCUMENTS

| | | | | |
|---|---|---|---|---|
| 2007/0059013 | A1* | 3/2007 | Mori et al. | 399/69 |
| 2008/0031647 | A1* | 2/2008 | Yoshikawa | 399/67 |
| 2010/0034548 | A1* | 2/2010 | Naitoh et al. | 399/69 |
| 2013/0084091 | A1* | 4/2013 | Taki et al. | 399/67 |
| 2013/0114967 | A1* | 5/2013 | Arimoto et al. | 399/70 |
| 2013/0272736 | A1* | 10/2013 | Sakamaki et al. | 399/67 |
| 2014/0356007 | A1* | 12/2014 | Kurokawa | 399/67 |

* cited by examiner

*Primary Examiner* — Clayton E Laballe
*Assistant Examiner* — Ruifeng Pu
(74) *Attorney, Agent, or Firm* — Patterson & Sheridan, LLP

(57) ABSTRACT

A fixing apparatus includes a rotating member, a fixing member including a lamination of a resin layer and a conductive layer, a sheet having an unfixed image being conveyed between the rotating member and the fixing member, a heating unit configured to cause heating of the fixing member, a support for one of the rotating member and the fixing member that is movable to change a relative position of the rotating member with respect to the fixing member, and a controller configured to turn on the heating unit in a state in which the rotating member is in contact with the fixing member.

12 Claims, 7 Drawing Sheets

FIXING APPARATUS AND IMAGE FORMING APPARATUS HAVING THE SAME

FIELD

Embodiments described herein relate generally to a fixing apparatus and an image forming apparatus having the same.

BACKGROUND

One type of fixing apparatus has a pressing roller and a fixing belt. A nip is formed between the pressing roller and the fixing belt, and an unfixed image is fixed onto a sheet when the sheet passes through the nip. One type of the fixing belt has a structure formed by laminating a resin layer and a conductive layer that generates heat through electromagnetic induction.

The resin layer of the fixing belt tends to absorb moisture in a high humidity environment. When the resin layer is heated rapidly, the moisture contained in the resin layer may evaporate rapidly, and this evaporation may cause peeling off of the resin layer from the conductive layer. If the resin layer is peeled off from the conductive layer, the fixing belt may have to be exchanged.

DETAILED DESCRIPTION

According to one embodiment, a fixing apparatus includes a rotating member, a fixing member including a lamination of a resin layer and a conductive layer, a sheet having an unfixed image being conveyed between the rotating member and the fixing member, a heating unit configured to cause heating of the fixing member, a support for one of the rotating member and the fixing member that is movable to change a relative position of the rotating member with respect to the fixing member, and a controller configured to turn on the heating unit in a state in which the rotating member is in contact with the fixing member.

Various embodiments will be described hereinafter with reference to the accompanying drawings.

Figure 1:
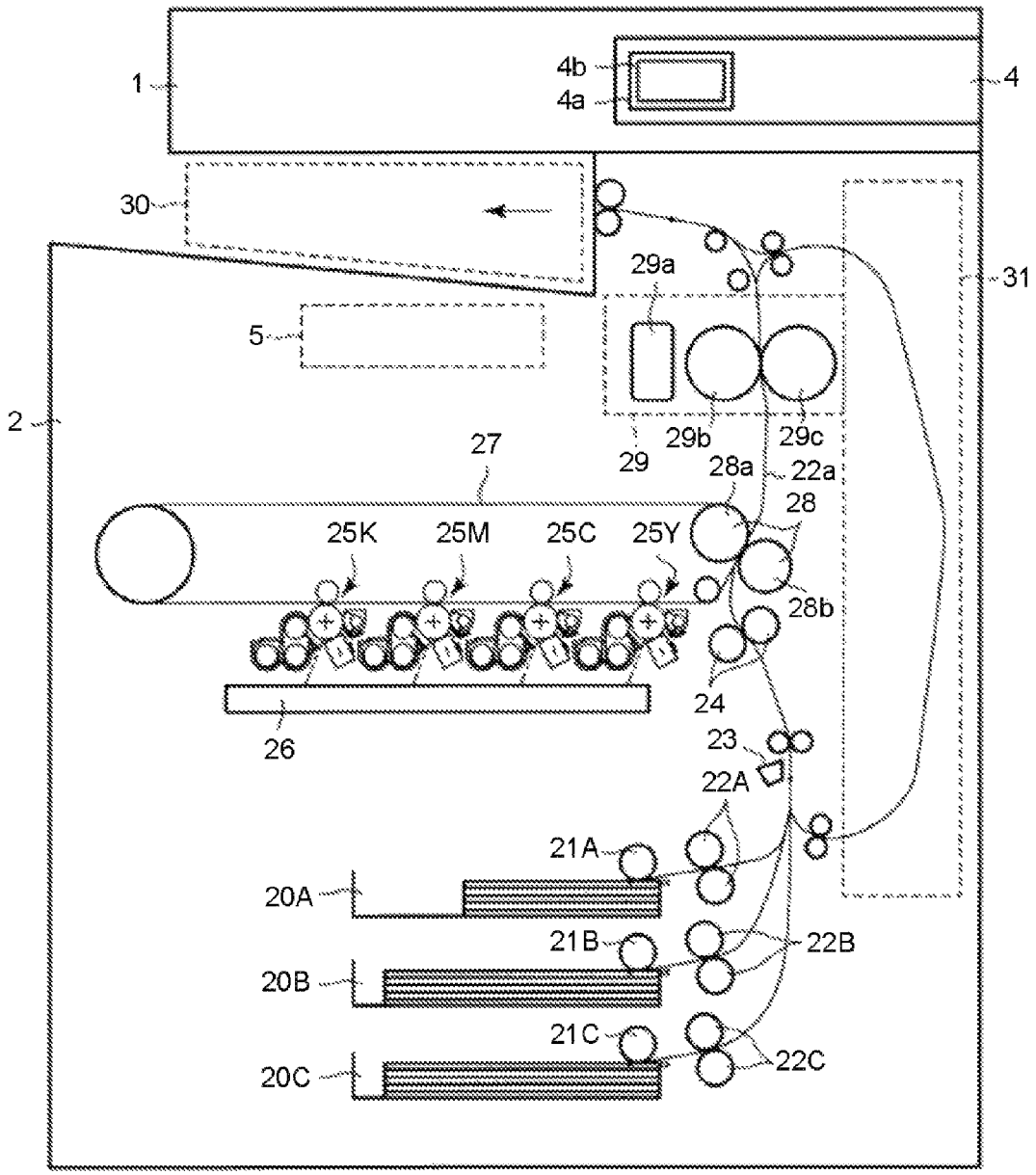
FIG. 1 is a schematic view of an image forming apparatus according to one embodiment.

FIG. 1 is a schematic view of a digital multi-functional peripheral serving as the image forming apparatus according to an embodiment. The digital multi-functional peripheral (MFP) according to the embodiment has a scanner 1, a printer 2, an operation panel 4, and a system control section 5.

The scanner 1 scans an image of a document and converts the image into image data. The scanner 1 includes, for example, a CCD line sensor for converting the image of the document placed on a reading surface into image data. The scanner 1 may be a scanner which scans a document manually placed on a document table glass or a scanner which reads an image of a document conveyed by an auto document feeder (ADF). The scanner 1 has a function (document detection function) of detecting the size of the document. The scanner 1 is arranged on, for example, the upper portion of a main body of the digital multi-functional peripheral. The scanner 1 controlled by the system control section 5 outputs the image data generated from the document to the system control section 5.

The printer 2 forms an image on paper serving as an image forming medium. The printer 2 has a color printing function of printing a color image on paper and a monochrome printing function of printing a monochrome (for example, black) image on paper. The printer 2, which is, for example, an electrophotographic type image forming apparatus, forms a color image with toner of a plurality of colors (for example, yellow (Y), cyan (C), and magenta (M)). The printer 2 forms a monochrome image with monochrome (for example, black) toner.

The printer 2 includes a plurality of paper feed cassettes 20A, 20B, and 20C (hereinafter generally referred to as paper feed cassette 20). The paper feed cassette 20 supplies paper on which the image is to be printed. The printer 2 may include a manual feeding tray. For example, each of the paper feed cassettes 20A, 20B and, 20C is detachably arranged at a lower portion of the main body of the digital multi-functional peripheral. Each of the paper feed cassettes 20A, 20B and, 20C stores paper of a set category (for example, size, and paper quality).

Setting information such as information relating to the paper stored in each paper feed cassette 20 is stored in a nonvolatile memory (for example, a later-described NVM 54). The printer 2 selects a paper feed cassette 20 in which the paper to be used in the printing processing is stored according to the setting information. The printer 2 prints an image on the paper fed from the selected paper feed cassette 20. When the printer 2 has a manual feeding tray, similar to each paper feed cassette 20, the setting information is also stored in the nonvolatile memory for the manual feeding tray.

The paper feed cassettes 20A, 20B, and 20C has pickup rollers 21A, 21B, and 21C (hereinafter generally referred to as pickup roller 21), respectively, at an end, from which the paper is conveyed. Each of the pickup rollers 21A, 21B and, 21C picks up, one by one, paper from the corresponding paper feed cassette 20A, 20B, or 20C. The pickup roller 21 supplies the picked up paper to a conveyance path (conveyance section) 22*a* along which a plurality of conveyance rollers are disposed. The number of the paper feed cassettes 20 serving as a paper feed section and the number of the pickup rollers 21 are not limited to three. For example, one, two, or more than three paper feed cassettes 20 and pickup rollers 21 may be arranged.

The paper is conveyed along the conveyance path 22*a* in the printer 2. The paper supplied by the pickup rollers 21A, 21B, and 21C is conveyed along the conveyance path 22*a* to a register roller 24. The register roller 24 conveys the paper to a transfer position at a timing when an image is transferred from an intermediate transfer belt 27 to the transfer position.

The paper is further conveyed along the conveyance path 22*a* to a nip between a fixing belt 29*d* and a pressing roller 29*c* of a fixing device 29.

Image forming sections 25Y, 25M, 25C, and 25K (hereinafter generally referred to as image forming section 25), an exposure section 26, the intermediate transfer belt 27, and a transfer section 28 function as an image forming module for forming an image. Each image forming section 25 forms an image of a corresponding color to be transferred to the paper. In FIG. 1, the image forming section 25Y forms an image with yellow toner. The image forming section 25M forms an image with magenta toner. The image forming section 25C forms an image with cyan toner. The image forming section 25K forms an image with black toner. The images formed by the image forming sections 25Y, 25M, 25C, and 25K are superposed and transferred to the intermediate transfer belt 27. In this way, a color image is formed on the intermediate transfer belt 27.

The exposure section 26 forms an electrostatic latent image on a photoconductive drum (image carrier) of each of the image forming sections 25Y, 25M, 25C, and 25K through a laser light. The exposure section 26 irradiates the photoconductive drum with the laser light controlled according to the image data through an optical system such as a polygon mirror and the like. The laser light from the exposure section 26 forms the electrostatic latent image on the surface of each photoconductive drum. The exposure section 26 controls the laser light according to a control signal from the system control section 5. The electrostatic latent image formed on each photoconductive drum is developed with the toner of a corresponding color. For example, the exposure section 26 controls the power of the laser light according to the control signal from the system control section 5. The exposure section 26 further controls the modulation amount of a pulse width and the like for controlling the light emission of the laser light according to the control signal from the system control section 5.

Each of the image forming sections 25Y, 25M, 25C, and 25K develops the electrostatic latent image formed on the photoconductive drum thereof with toner of a corresponding color. Each of the image forming sections 25Y, 25M, 25C, and 25K forms a toner image (developer image) serving as a visible image on the photoconductive drum. The intermediate transfer belt 27 is an intermediate transfer body. Each of the image forming sections 25Y, 25M, 25C, and 25K transfers (primarily transfers) the toner image formed on the photoconductive drum to the intermediate transfer belt 27. Each of the image forming sections 25Y, 25M, 25C, and 25K applies a transfer bias to the toner image at a primary transfer position. Each of the image forming sections 25Y, 25M, 25C, and 25K controls the transfer bias through a transfer current. The toner image on each photoconductive drum is transferred to the intermediate transfer belt 27 through the transfer bias at the primary transfer position thereof. The system control section 5 controls the transfer current used by each image forming section in the primary transfer processing.

Further, each of the image forming sections 25Y, 25M, 25C, and 25K has a sensor such as a potential sensor, a concentration sensor, and the like, respectively. The potential sensor is a sensor for detecting a surface potential of the photoconductive drum. In each of the image forming sections 25Y, 25M, 25C, and 25K, an electrostatic charger charges the surface of the photoconductive drum before it is exposed by the exposure section 26. The system control section 5 can change the charging condition based on the electrostatic charger. The potential sensor detects the surface potential of the photoconductive drum the surface of which is charged by the electrostatic charger. The concentration sensor detects the concentration of the toner image transferred to the intermediate transfer belt 27. Further, the concentration sensor may also be a sensor for detecting the concentration of the toner image formed on the photoconductive drum.

For example, in a case of forming a monochrome image, the image forming section 25K transfers (primarily transfers) the toner image developed with the black (monochrome) toner to the intermediate transfer belt 27. As a result, the intermediate transfer belt 27 holds a monochrome image formed with black (monochrome) toner.

Further, in a case of forming a color image, the toner images formed by the image forming sections 25Y, 25M, 25C, and 25K with the toner of corresponding color (yellow, magenta, cyan, and black) are superimposed and transferred (primarily transfer) to the intermediate transfer belt 27. As a result, the intermediate transfer belt 27 holds a color image obtained by the overlapping of the toner images of the colors.

The transfer section 28 transfers the toner image on the intermediate transfer belt 27 to the paper at a secondary transfer position. The secondary transfer position is a position where the toner image on the intermediate transfer belt 27 is transferred to the paper. The secondary transfer position is also a position where a support roller 28*a* and a secondary transfer roller 28*b* are opposed to each other. The transfer section 28 applies a transfer bias which is controlled through a transfer current at the secondary transfer position. The transfer section 28 transfers the toner image on the intermediate transfer belt 27 to the paper through the transfer bias. The system control section 5 controls the transfer current used in a secondary transfer processing.

A fixing device 29 applies heat and pressure to the paper to fix the toner image onto the paper. The fixing device 29 includes a magnetic field generator 29*a*, a fixing roller 29*b*, and a pressing roller 29*c*. The fixing belt 29*d* is provided over the outer peripheral surface of the fixing roller 29*b*. The magnetic field generator 29*a* generates a magnetic field for generating eddy current in a conductive layer 132 (See FIG. 6) of the fixing belt 29*d*, thereby heating the fixing roller 29*b*. The pressing roller 29*c* can be moved to a contact position where the pressing roller 29*c* is in contact with the fixing roller 29*b* with a pressure, a separation position where the pressing roller 29*c* is separated from the fixing roller 29*b*, and a semi-contact position where the pressing roller 29*c* is in contact with the fixing roller 29*b* with a slight pressure. The fixing device 29 includes a separating and contacting mechanism 80 (See FIG. 3) for moving the pressing roller 29*c* to the contact position, the separation position, and the semi-contact position.

For example, in a case of fixing the toner image on the paper, the system control section 5 controls the fixing device 29 to a fixing temperature. The fixing device 29 controlled to be at the fixing temperature presses the paper to which the toner image is transferred by the transfer section 28 and meanwhile heats the paper at the fixing temperature. In this way, the fixing device 29 fixes the toner image on the paper. Further, the fixing device 29 conveys the paper on which the toner image is fixed to either of a paper discharge section 30 or an automatic double-sided unit (ADU) 31.

When the paper fed from the fixing device 29 is discharged, the paper is conveyed to the paper discharge section 30. When an image is also formed on the back side of the paper fed from the fixing device 29, the paper is first conveyed to the side of the paper discharge section 30, and is then switched back and conveyed to the ADU 31. In this case, the ADU 31 conveys the paper which is reversed through the switchback, to the conveyance path 22*a* in front of the register roller 24 again.

The operation panel 4 is a user interface. The operation panel 4 has a display section 4*a* and a touch panel 4*b* disposed thereon. The system control section 5 controls the content to be displayed on the display section 4*a* of the operation panel 4. Further, the operation panel 4 outputs information input through the touch panel 4*b* of the display section 4*a* to the system control section 5. A user designates various operation modes, or inputs information such as setting information and the like through the operation panel 4. For example, the user selects a mode for executing printing on normal paper or a mode for executing printing on an envelope or thick paper through the operation panel 4. The operation panel 4 includes a power source button 4*c* (FIG. 2).

Next, a control system of the digital multi-functional peripheral is described.

Figure 2:
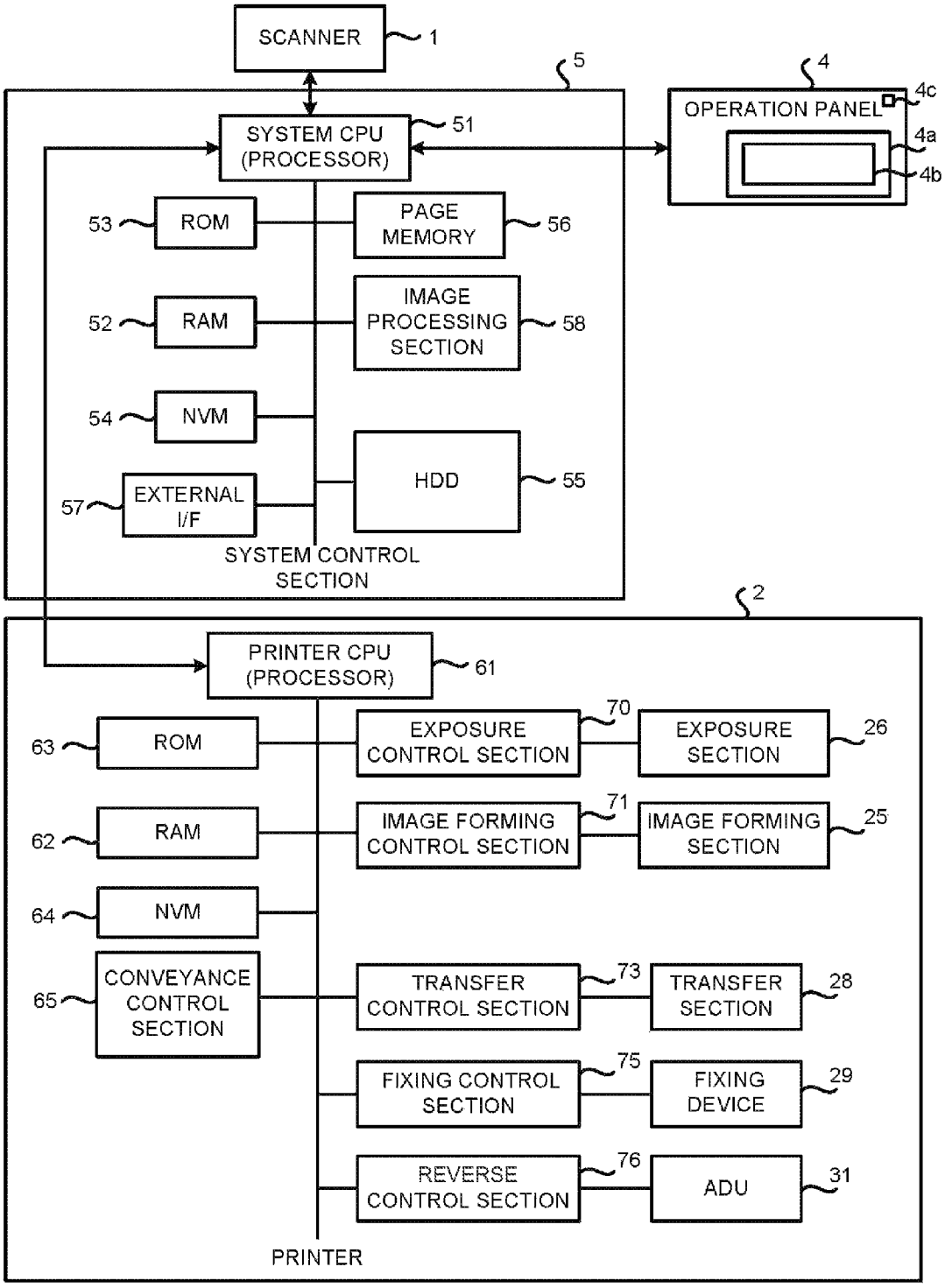
FIG. 2 is a block diagram of a control system of the image forming apparatus.

As shown in FIG. 2, the system control section 5 includes a system CPU (processor) 51, an RAM 52, an ROM 53, a non-volatile memory (NVM) 54, an HDD 55, a page memory 56, an external interface (I/F) 57, and an image processing section 58.

The system CPU 51 uniformly controls the whole digital multi-functional peripheral and each control section. The system CPU 51, which is a processor for carrying out processing by executing programs, is connected with each control section of the system control section 5 through a system bus. In addition to each section of the system control section 5, the system CPU 51 is also connected with the control sections of the scanner 1, the printer 2, the operation panel 4, and the like through the system bus. The system CPU 51 outputs an operation instruction to each control section and acquires various kinds of information from each control section through a bidirectional communication with the scanner 1, the printer 2, and the operation panel 4. Further, the system CPU 51 inputs information indicating detection signals of various sensors arranged in each section of the system control section 5, an operation state, and the like.

The RAM 52 is a volatile memory. The RAM 52 functions as a working memory or a buffer memory. The ROM 53 is an unrewritable non-volatile memory for storing programs, control data, and the like. The system CPU 51 carries out various processing by executing the programs stored in the ROM 53 (or the non-volatile memory 54 or the HDD 55) using the RAM 52.

The non-volatile memory (NVM) 54 is a rewritable non-volatile memory which stores the control programs executed by the system CPU 51 and the control data. Further, the NVM 54 stores various kinds of setting information, processing conditions, and the like. For example, the NVM 54 stores the setting information of the category (normal paper, envelope, thick paper and the like) of the medium to be passed through the fixing device.

The hard disk drive (HDD) 55 is a high-capacity storage device. The HDD 55 stores the image data, various kinds of operation history information, and the like. Further, the HDD 55 may also store the control programs, the control data, and the like, or store the setting information, the processing conditions, and the like.

The page memory 56 is a memory for developing the image data to be processed. For example, in a case of carrying out copy processing, the page memory 56 stores the image data which is generated by the scanner 1 and is subjected to the image processing. The system CPU 51 carries out the image processing for printing of the image data stored in the page memory 56, and outputs the processed image data to the printer 2. Further, the system CPU 51 stores the image data stored in the page memory 56 in the HDD 55, or sends the image data to an external device through the external interface 57.

The external interface (I/F) 57 is an interface for communicating with the external device. For example, the external interface 57 receives print data corresponding to a print request from the external device. The external interface 57 may be an interface for carrying out data transmission/reception with the external device, and, for example, the external interface 57 may be an interface locally connected with the external device, or a network interface for communicating through a network.

The image processing section 58 has functions of an image processing section of a scanner system for carrying out an image processing on the image data read by the scanner 1, a compression and expansion section for carrying out compression or expansion processing on the image data, an image processing section of a printer system for generating the image data for printing to be printed by the printer 2 on paper, and the like. For example, as the image processing section of a scanner system, the image processing section 58 has functions such as shading correction processing, gradation conversion processing, inter-line correction processing, and the like.

Next, a control system of the printer 2 is described.

As shown in FIG. 2, the printer 2 includes a printer CPU (processor) 61, an RAM 62, an ROM 63, a non-volatile memory (NVM) 64, a conveyance control section 65, an exposure control section 70, an image forming control section 71, a transfer control section 73, a fixing control section 75, and a reverse control section 76 and the like. The printer CPU 61, the RAM 62, and the ROM 63 function as a control section.

The printer CPU 61 controls the whole printer 2. The printer CPU 61, which is a processor carrying out processing by executing programs, is connected with each control section of the printer 2 through a system bus and the like. The printer CPU 61 outputs, in response to the operation instruction from the system CPU 51, an operation instruction to each control section of the printer 2, and notifies the system CPU 51 of various kinds of information acquired from each control section.

The RAM 62 is a volatile memory. The RAM 62 functions as a working memory or a buffer memory. The ROM 63 is an unrewritable non-volatile memory for storing programs, control data, and the like. The printer CPU 61 realizes various processing by executing the programs stored in the ROM 63 (or the NVM 64) using the RAM 62.

The NVM 64 is a rewritable non-volatile memory which stores, for example, the control programs executed by the printer CPU 61 and the control data. Further, the NVM 64 may store the setting information, processing conditions, and the like.

The conveyance control section 65 controls the paper conveyance in the printer 2 and the driving of the pickup roller 21 and the conveyance rollers arranged along the conveyance path 22*a*. The conveyance control section 65 controls the driving of the conveyance rollers in the printer 2 in response to the operation instruction from the printer CPU 61. For example, the printer CPU 61 instructs, in response to an instruction of starting image forming processing from the system control section 5, the conveyance control section 65 to start to feed the paper by the pickup roller 21 and the conveyance rollers.

A control section (not shown) of the scanner 1 scans the image on the document in response to the operation instruction from system CPU 51. The control section transfers the image data generated by the scanner 1 to the system control section 5. The system control section 5 stores the image data generated by the scanner 1 in the HDD 55.

The exposure control section 70 receives a command of the printer CPU 61 to control the exposure section 26. That is, the exposure control section 70 forms, through the exposure section 26, the electrostatic latent image on the photoconductive drum of each of the image forming sections 25Y, 25M, 25C, and 25K, in response to the operation instruction from the printer CPU 61. For example, the exposure control section 70 controls, in response to the image data instructed by the printer CPU 61, the laser light emitted towards each photoconductive drum by the exposure section 26.

The image forming control section 71 receives a command of the printer CPU 61 to control the driving of each of the image forming sections 25Y, 25M, 25C, and 25K. That is, the image forming control section 71 develops, in response to the operation instruction from the printer CPU 61, the electrostatic latent image formed on the photoconductive drum of each of the image forming sections 25Y, 25M, 25C, and 25K with the toner of the corresponding color.

The transfer control section 73 receives a command of the printer CPU 61 to control the driving of the transfer section 28, the transfer current, and the like. That is, the transfer control section 73 transfers, in response to operation instruction from the printer CPU 61, the toner image transferred to the intermediate transfer belt 27 to the paper through the transfer section 28.

The fixing control section 75 receives a command of the printer CPU 61 to control the driving of the fixing device 29. That is, the fixing control section 75 drives the fixing roller 29*b* and the pressing roller 29*c* in response to the operation instruction from the printer CPU 61. Further, the fixing control section 75 receives a command of the printer CPU 61 to control the magnetic field generator 29*a*, so as to control the surface temperature of the fixing roller 29*b* to a desired temperature. That is, the fixing control section 75 controls the surface temperature of the fixing roller 29*b* to a temperature (fixing temperature) designated by the printer CPU 61.

The reverse control section 76 receives a command of the printer CPU 61 to control the driving of the ADU 31. That is, the reverse control section 76 supplies, in response to the operation instruction from the printer CPU 61, the paper passing through the fixing device 29 to the image reading position of the scanner 1 through the ADU 31. For example, in a case of an image forming on the back side of the paper subjected to the fixing processing (in a case of duplex printing), the reverse control section 76 conveys first the paper subjected to the fixing processing to the side of the paper discharge section 30, and then switches back and conveys the paper to the ADU 31. The ADU 31 resupplies the paper switched back from the paper discharge section 30 to the register roller 24. In this way, the paper is supplied to the register roller 24 in a reversed state.

The printer CPU 61 stores the setting information for each paper feed cassette 20 in the NVM 64. The setting information of each paper feed cassette includes, for example, the size and the paper category (normal paper, envelope, thick paper, and the like) of the supplied (stored) paper. The paper size may be set through a sensor and the like arranged in each paper feed cassette 20. The paper category is set by a user or a manager through the operation panel 4.

Figure 3:
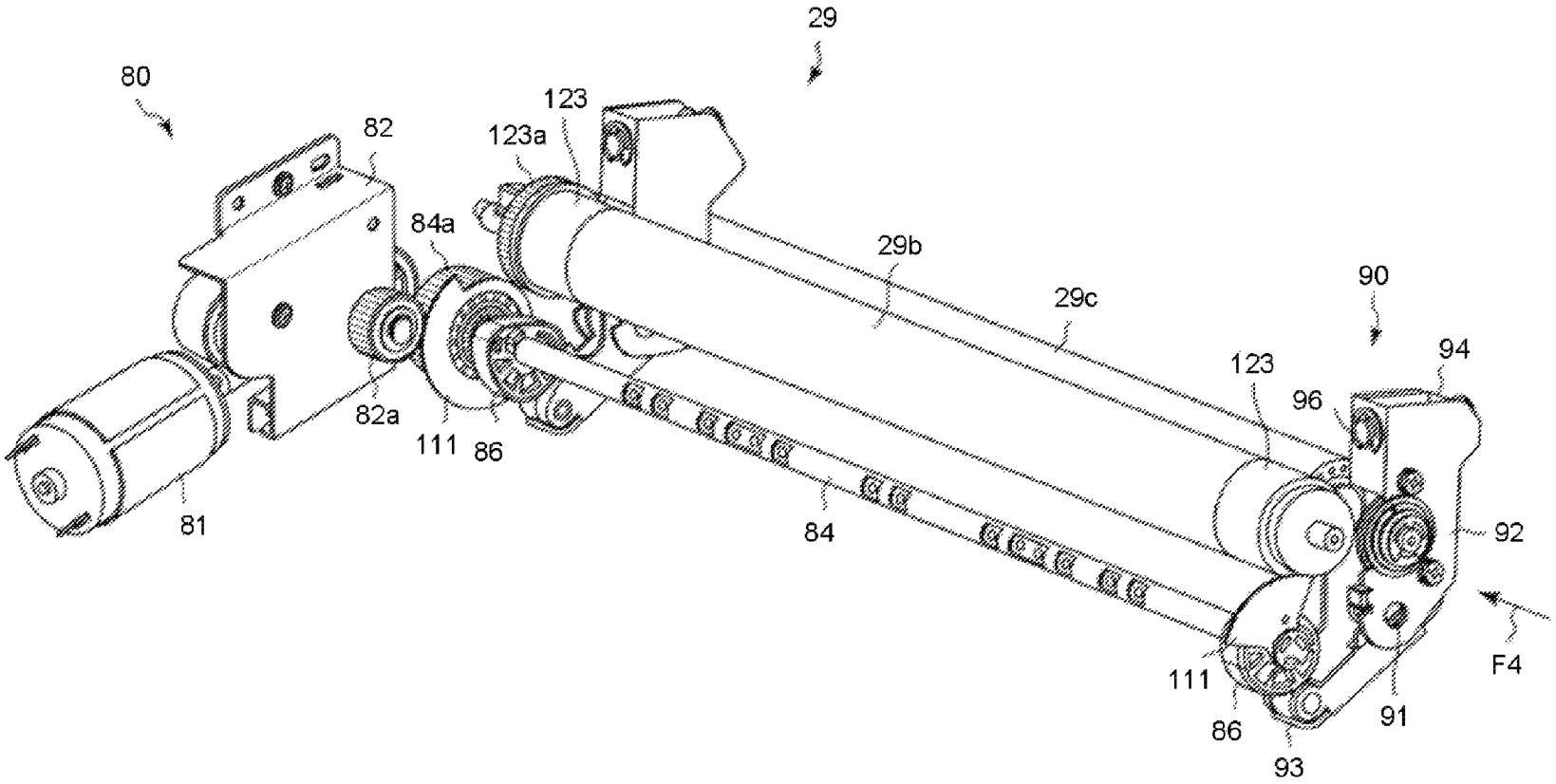
FIG. 3 is a schematic perspective view of a fixing device provided in the image forming apparatus.
Figure 4:
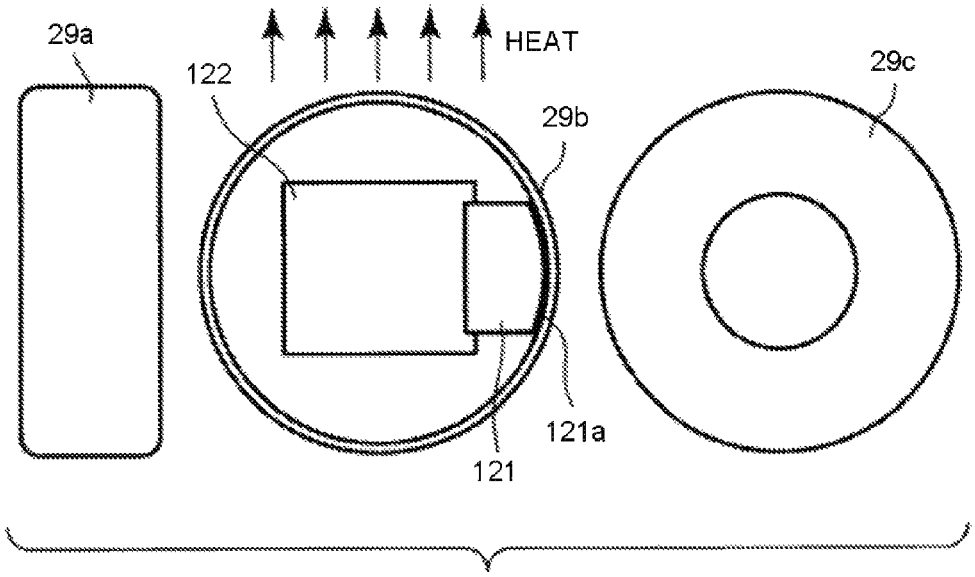
FIG. 4 illustrates a state of the fixing device in which a pressing roller of the fixing device is positioned at a separation position.
Figure 5:
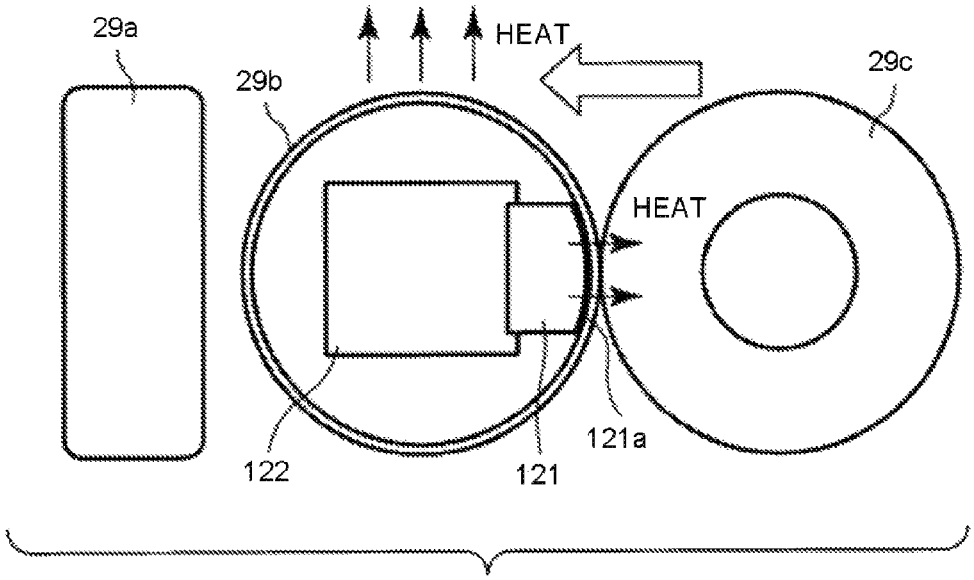
FIG. 5 illustrates a state the fixing device in which the pressing roller of the fixing device is positioned at a semi-contact position.
Figure 6:
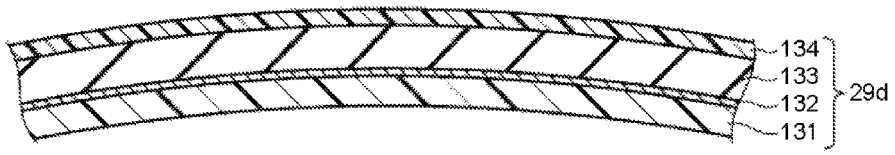
FIG. 6 is an enlarged cross-sectional view of a layer structure of a fixing belt of the fixing device.

Next, the structure of the fixing device 29 arranged in the printer 2 is described with reference to FIG. 3-FIG. 6. FIG. 3 is a perspective view of the fixing device 29, FIG. 4 illustrates a state of the fixing device 29 in which the pressing roller 29*c* is positioned at the separation position, FIG. 5 illustrates a state in which the pressing roller 29*c* is positioned at the semi-contact position, and FIG. 6 is an enlarged cross-sectional view of a layer structure of the fixing belt 29*d*.

The fixing device 29 includes the fixing roller 29*b* and the pressing roller 29*c* which are arranged opposite to each other across the paper conveyance path 22*a* (FIG. 1). The fixing device 29 further includes the separating and contacting mechanism 80 for separating the pressing roller 29*c* from or bringing the pressing roller 29*c* in contact with the fixing roller 29*b*. The fixing belt 29*d* according to the present embodiment has the layer structure (described in detail later) shown in FIG. 6. As shown in FIG. 4 and FIG. 5, the fixing belt 29*d* is formed in an endless cylindrical shape.

A pressing pad 121 is arranged inside the fixing roller 29*b* to nip the fixing belt 29*d* between the pressing roller 29*c* and the fixing roller 29*b*. The fixing belt 29*d* deforms under an external force. The pressing pad 121 supports the fixing belt 29*d* from inside so that the fixing belt 29*d* is not curved toward inside when the pressing roller 29*c* is pressed against the fixing belt 29*d*.

A fixed frame (not shown) is arranged inside the fixing roller 29*b*. The fixed frame has a cutout opening (not shown) through which the pressing pad 121 is urged towards the fixing belt 29*d*.

The pressing pad 121 is fixed on the fixed frame (not shown) of the digital multi-functional peripheral through a supporting member 122. The pressing pad 121 has a contact surface 121*a* at which the pressing pad 121 is in contact with the inner surface of the fixing belt 29*d*. The contact surface 121*a* is curved along the inner surface of the fixing belt 29*d*. The pressing pad 121 has a length longer than the width of the paper passing area along the axis direction of the fixing roller 29*b*, and the pressing roller 29*c* is pressed over the approximate entire length of the pressing pad 121.

The fixing roller 29*b* includes two approximate columnar caps 123 at two ends in the axis direction thereof. The caps 123 are respectively fitted into each end of the fixing roller 29*b* to maintain the cylindrical shape of the fixing belt 29*d* and meanwhile support the two ends in the axis direction of the fixing roller 29*b* in a rotatable manner. That is, these two caps 123 are rotatably supported by the fixed frame (not shown) of the digital multi-functional peripheral. The cap 123 at the left side of FIG. 3 includes a gear 123*a* for transferring the driving force for rotating the fixing roller 29*b*.

The fixing roller 29*b* having the structure described above and the pressing roller 29*c* are arranged parallel to each other and extend from the rear side towards the front side (a direction substantially perpendicular to the paper surface in FIG. 1) of the digital multi-functional peripheral. The magnetic field generator 29*a* (FIG. 4 and FIG. 5) is arranged nearby the fixing roller 29*b* at the other side of the fixing roller 29*b* opposite to the pressing roller 29*c*. (For the sake of clarity of illustration in FIG. 3, the magnetic field generator 29*a* is not shown in FIG. 3.) The magnetic field generator 29*a* has a length equal to or longer than a length of the fixing roller 29*b* and the pressing roller 29*c*.

The magnetic field generator 29*a* includes an exciting coil (not shown) wound around a core member (not shown). The core member is positioned and fixed on the fixed frame (not shown) in such a manner that the exciting coil is arranged nearby but at a certain distance from the fixing roller 29*b*. A high frequency current is supplied to the exciting coil from a later-described power supply circuit 103 under the control of the fixing control section 75. In this way, a magnetic flux that repeats generation and extinction around the exciting coil at high frequency is formed.

The magnetic flux crosses a conductive layer 132 (FIG. 6) of the fixing belt 29*d*. The magnetic flux repeats generation and extinction across the conductive layer 132, and, as a result, the eddy current is generated in the conductive layer 132 to generate a magnetic field that prevents the change in the magnetic field. Joule heat is generated in the conductive layer 132 through the eddy current, in this way. As a result, the conductive layer 132 is heated, and, further, the entire fixing roller 29*b* is heated.

The separating and contacting mechanism 80 moves the pressing roller 29*c* to the contact position where the pressing roller 29*c* is in contact with the fixing roller 29*b* with a given pressure and a nip is formed between the pressing roller 29*c* and the fixing roller 29*b*. The separating and contacting mechanism 80 moves the pressing roller 29*c* to the separation position (position shown in FIG. 4) where the pressing roller 29*c* is separated from the fixing roller 29*b*. Alternatively, the separating and contacting mechanism 80 moves the pressing roller 29*c* to the semi-contact position (position shown in FIG. 5) where the pressing roller 29*c* is in contact with the fixing roller 29*b* with a pressure smaller than the pressure applied when the pressing roller 29*c* is at the contact position.

For example, when the category (normal paper) of the paper is input as the setting information by a user through the operation panel 4, the separating and contacting mechanism 80 positions the pressing roller 29*c* at the contact position. For example, when the category (envelope or thick paper) of the paper is input as the setting information by a user through the operation panel 4, the separating and contacting mechanism 80 positions the pressing roller 29*c* at the semi-contact position.

The two ends in the axis direction of the fixing roller 29*b* are rotatably supported by the fixed frame (not shown) of the digital multi-functional peripheral through the caps 123 described above. On the other hand, the two ends of the rotational axis of the pressing roller 29*c* are rotatably held by holding arms 90, respectively. These two holding arms 90 are synchronously rotated around a rotation axis 91 against the fixed frame (not shown) to separate the pressing roller 29*c* from the fixing roller 29*b*. The holding arms 90 arranged at the two ends of the pressing roller 29*c* are structurally identical to each other; thus, only the holding arm 90 arranged at the right side of FIG. 3 is described representatively.

The holding arm 90 includes an arm main body 92, which has a cam follower 93 at one end thereof, and a movable arm 94 which is rotatably arranged on the arm main body 92. The arm main body 92 generally energizes the cam follower 93 in a direction to press the cam follower 93 against a cam 86 through a spring (not shown) and the like. The movable arm 94 supports the two ends of the rotational axis of the pressing roller 29*c* in a rotatable manner.

The arm main body 92 is arranged on the fixed frame (not shown) of the digital multi-functional peripheral through the rotational axis 91 described above. The movable arm 94 is arranged on the arm main body 92 in a state in which the movable arm 94 can be rotated around the rotational axis 91. One end of a compression spring 96 arranged between the arm main body 92 and the movable arm 94 is positioned at the other side of the movable arm 94 that is farther from the rotation axis 91.

Thus, in a state in which the pressing roller 29*c* is positioned at the contact position, the compression spring 96 is compressed strongly, and the pressing roller 29*c* is pressed against the fixing roller 29*b* with a relatively strong pressure. In a state in which the pressing roller 29*c* is positioned at the semi-contact position, the compression spring 96 is compressed slightly; thus, the pressing roller 29*c* is pressed against the fixing roller 29*b* with a relatively small pressure.

That is, the compression spring 96 is compressed for a distance corresponding to a rotation displacement amount of the movable arm 94 against the arm main body 92 when the pressing roller 29*c* is pressed against the fixing roller 29*b*. The pressing roller 29*c* is elastically pressed against the fixing roller 29*b* through the restoring force of the spring in the compressed state. That is, the pressure from the compression spring 96 is generated at the moment the pressing roller 29*c* is in contact with the fixing roller 29*b*.

The separating and contacting mechanism 80 moves the cam followers 93 of the pair of holding arm 90 to rotate the pair of holding arm 90, so as to separate the pressing roller 29*c* from or bring the pressing roller 29*c* in contact with the fixing roller 29*b*. As shown in FIG. 3, the separating and contacting mechanism 80 includes a DC motor 81, a gear box 82, a cam shaft 84, and two cams 86.

The DC motor 81 can be operated in a forward and a backward direction. The gear box 82, which includes a plurality of gears (one part is not shown) meshing with each other, transfers the rotation of the DC motor 81 to the gear 82*a* through the plurality of gears while slowing down the rotational rate.

The cam shaft 84 is arranged substantially parallel to the fixing roller 29*b* and the pressing roller 29*c*, and the cam 86 is provided at each end thereof. These two cams 86 are arranged at the two ends of the cam shaft 84 in the same manner. These two cams 86, which are rotating plates deformed in the peripheral surface (cam surface), are arranged in such a manner that the cam surface thereof is in contact with each cam follower 93 of the holding arm 90.

A gear 84*a* meshing with the gear 82*a* is arranged at one end (left end in FIG. 3) of the cam shaft 84. Thus, the cams 86 arranged at two ends of the cam shaft 84 can be rotated in the forward and backward direction through the rotation of the DC motor 81. If the cam 86 is rotated, the distance between the part of the cam surface that is in contact with the cam follower 93 and the rotation center of the cam 86 is changed, and, therefore, the cam follower 93 is moved based on the change of the distance.

As shown in FIG. 6, the fixing belt 29*d* arranged around the peripheral surface of the fixing roller 29*b* has a layer structure formed by laminating a heat-resistant resin layer 131, the conductive layer 132 for generating heat, an elastic layer 133 for improving fixing property, and a release layer 134 having a good releasing property for the toner image in sequence from the inside towards the outside. The resin layer 131 formed of polyimide (PI) functions as a protective layer for protecting the inner surface of the fixing belt 29*d*. The conductive layer 132 is formed of metal such as iron, cobalt, nickel, copper, aluminum, chromium, and the like. The elastic layer 133 is formed of a material having good heat conductivity, such as silicone rubber, fluororubber, fluorosilicone rubber, and the like. The release layer 134 is formed of copolymer of tetrafluoroethylene and perfluoro alkyl vinyl ether (PFA).

Figure 7:
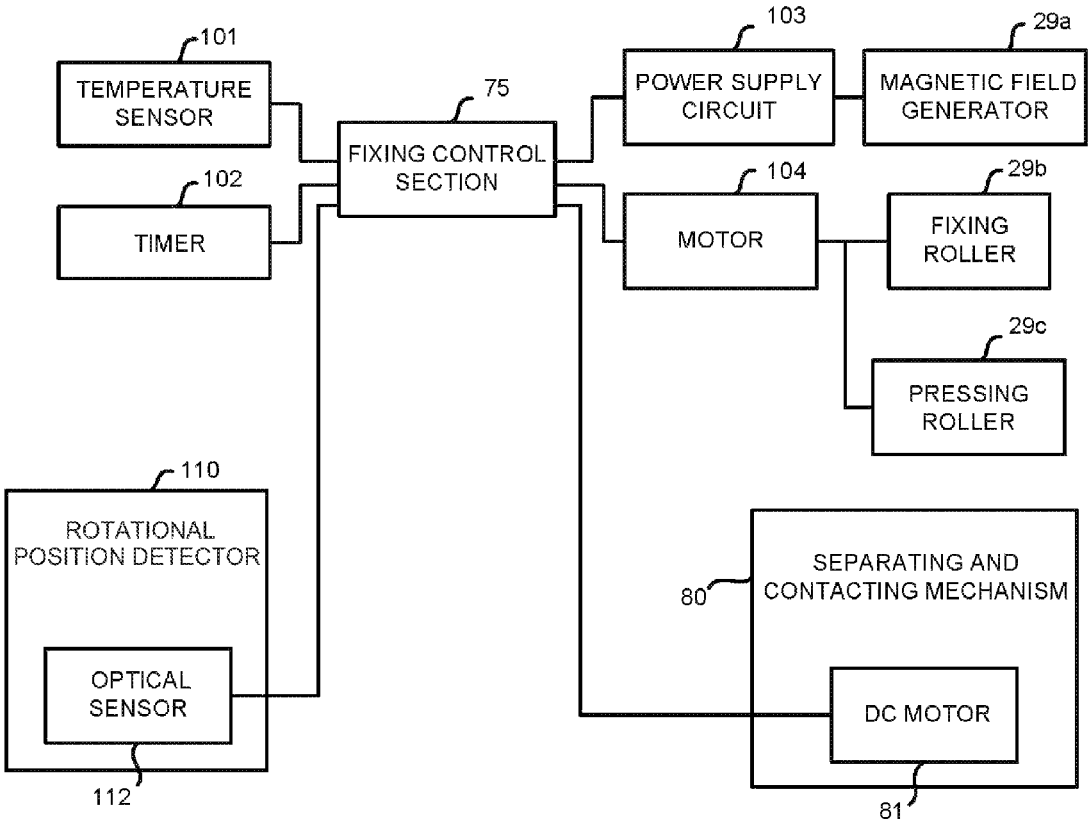
FIG. 7 is a block diagram of a control system of the fixing device.

Next, a control system for controlling the fixing device 29 having the structure described above is described with reference to a block diagram shown in FIG. 7.

The fixing control section 75 (hereinafter simply referred to as control section 75) is connected with a temperature sensor 101 for detecting a surface temperature of the fixing roller 29*b* and a timer 102 used for managing time. The control section 75 is also connected with the power supply circuit 103 (power supply section) for supplying power to the magnetic field generator 29*a* of the fixing device 29, a motor 104 (rotation mechanism) for rotating the fixing roller 29*b* and the pressing roller 29*c* in the paper conveyance direction, the DC motor 81 of the separating and contacting mechanism 80, and a rotational position detector 110 for detecting the rotational position of the cam 86.

The rotational position detector 110 is arranged at the two ends of the cam shaft 84. The rotational position detector 110 includes light shielding plates 111 (FIG. 3) arranged at the end regions of the cam shaft 84 and optical sensors 112 for detecting the notch of the light shielding plates 111. The rotational position detector 110, which includes the optical sensors 112 of which the optical axis is shielded by the light shielding plates 111 rotating along with the cam shaft 84, detects the rotational position of the cam 86 through the light and dark signal of the optical sensors 112.

Figure 8:
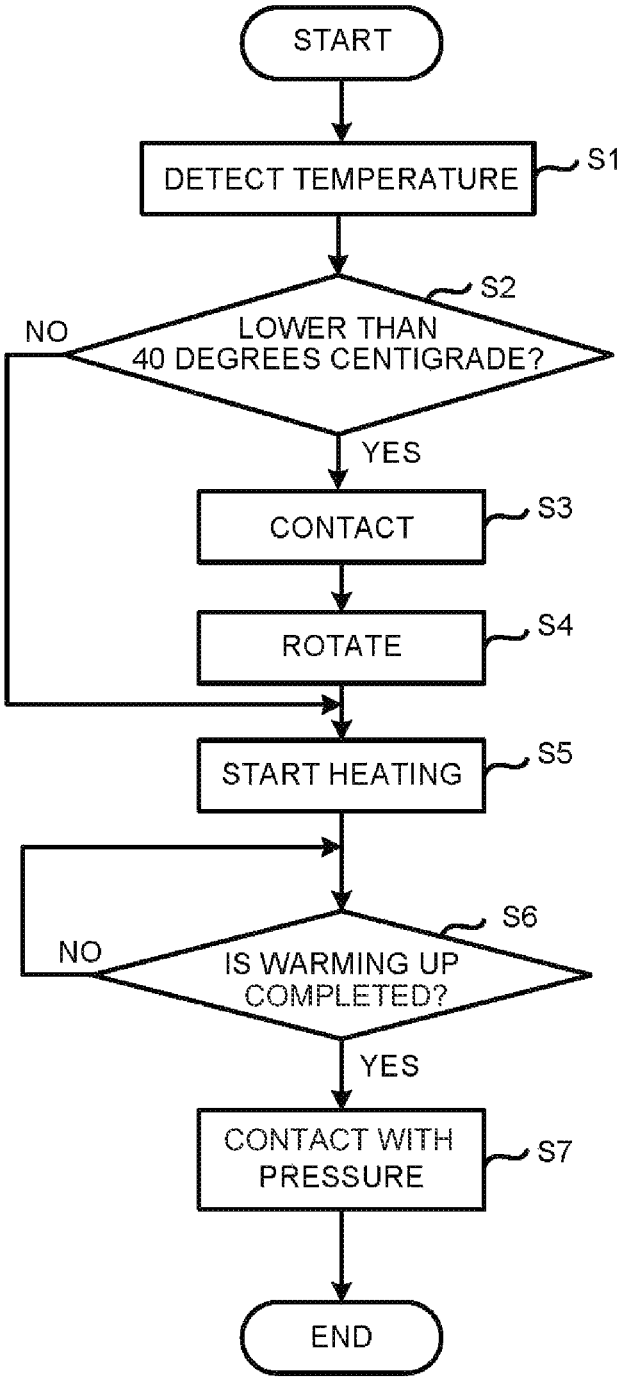
FIG. 8 is a flowchart of a warming up operation carried out by the control system.

Next, the warming up operation of the fixing device 29 having the structure described above is described with reference to the flowchart shown in FIG. 8. The warming up refers to preparatory heating of the fixing device before printing, and the warming up operation is carried out in a case of heating the fixing device when the power is turned on and in a case of receiving a print command and resuming from a standby state.

In order to properly fix the toner image onto the paper conveyed through the conveyance path 22*a*, the control section 75 of the fixing device 29 carries out a control operation to heat (preheat) the fixing roller 29*b* and the pressing roller 29*c* to a predetermined fixing temperature (e.g., 170 degrees centigrade). For example, when the power of the digital multi-functional peripheral is turned on, or when the digital multi-functional peripheral resumes after a jam processing, if the temperature of the fixing device 29 is lower than the fixing temperature, the warming up operation of the fixing device 29 is carried out.

At this time, the control section 75 detects the temperature of the fixing roller 29*b* through the temperature sensor 101 first (ACT S1). When the temperature of the fixing roller 29*b* detected in ACT S1 is lower than 40 degrees centigrade (YES in ACT S2), the control section 75 controls the separating and contacting mechanism 80 to move the pressing roller 29*c* from the separation position shown in FIG. 4 to the semi-contact position shown in FIG. 5 so that the pressing roller 29*c* is in contact with the fixing roller 29*b* (ACT S3).

In this state, the control section 75 energizes the motor 104 to rotate the fixing roller 29*b* and the pressing roller 29*c* slowly (ACT S4). Then, the control section 75 controls the power supply circuit 103 to supply power to the magnetic field generator 29*a* to heat the conductive layer 132 of the fixing roller 29*b* and start the heating of the fixing roller 29*b* (ACT S5). The heat of the fixing roller 29*b* is transferred to the pressing roller 29*c* which is rotating in a state of being in contact with the fixing roller 29*b*; in this way, the whole fixing device 29 is preheated.

After the heating of the fixing roller 29*b* is started in ACT S5, the control section 75 monitors the output of the temperature sensor 101 and determines whether or not the temperature of the fixing roller 29*b* reaches the fixing temperature (ACT S6). When the temperature of the fixing roller 29*b* reaches the fixing temperature, the control section 75 determines that warming up operation is completed (YES in ACT S6), and energizes the DC motor 81 of the separating and contacting mechanism 80 to move the pressing roller 29*c* from the semi-contact position to the contact position (ACT S7).

On the other hand, when the temperature of the fixing roller 29*b* detected in ACT S1 is higher than 40 degrees centigrade (NO in ACT S2), the control section 75 starts the heating of the fixing roller 29*b* in a state in which the pressing roller 29*c* is positioned at the separation position (ACT S5). After the temperature of the fixing roller 29*b* reaches the fixing temperature (YES in ACT S6), the control section 75 controls the separating and contacting mechanism 80 to move the pressing roller 29*c* from the separation position to the contact position (ACT S7).

Incidentally, the fixing roller 29*b* according to the present embodiment includes the resin layer 131 (FIG. 6) formed of polyimide (PI). PI is known as a resin material having a relatively high hygroscopicity. Thus, if the resin layer 131 formed of PI which contains moisture in a high humidity environment is arranged from a low-temperature environment to a high-temperature environment, the moisture in the resin layer 131 may evaporate.

For example, when the power-OFF state continues for a given time and the fixing device 29 is not preheated, it is considered that the temperature of the fixing roller 29*b* is almost equal to the environment temperature (15-25 degrees centigrade). If the fixing roller 29*b* is rapidly heated (to a temperature about 170 degrees centigrade) from this state in a short time, the moisture absorbed in the resin layer 131 may evaporates, which may lead to an issue that the conductive layer 132 and the resin layer 131 are peeled off from each other.

In the present embodiment, to prevent such an issue, as stated in ACT S1 and ACT S2, during the warming up of the fixing device 29, the temperature of the fixing roller 29*b* is detected, and it is determined whether or not the temperature of the fixing roller 29*b* reaches a temperature (evaporation temperature) at which the moisture contained in the resin layer 131 evaporates. When the temperature of the fixing roller 29*b* is lower than the evaporation temperature, as stated in ACT S3, the pressing roller 29*c* is brought to be in contact with the fixing roller 29*b*.

The evaporation temperature mentioned here refers to a temperature of the fixing roller 29*b* (e.g., 40 degrees centigrade in the present embodiment) at which the moisture contained in the resin layer 131 starts to evaporate. In other words, when the temperature of the fixing roller 29*b* is lower than the evaporation temperature, the moisture contained in the resin layer 131 remains in the resin layer 131, and when the temperature of the fixing roller 29*b* is higher than the evaporation temperature, the moisture contained in the resin layer 131 starts to evaporate.

Figure 9:
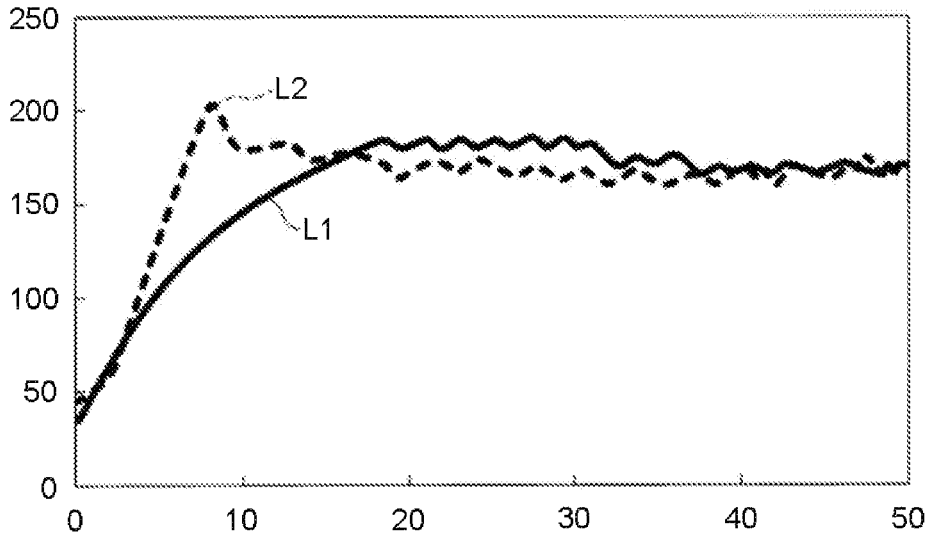
FIG. 9 is a graph showing transition of the temperature of a fixing roller over time during the warming up operation.

If the pressing roller 29*c* is brought to be in contact with the fixing roller 29*b* in ACT S3, the heat capacity of the target to be heated is larger than that in a case of heating the fixing roller 29*b* only. Thus, when the same heat is applied, as shown in FIG. 9, an increase (L1) of the temperature of the fixing roller 29*b* when the pressing roller 29*c* is in contact with the fixing roller 29*b* is more gradual than an increase (L2) of the temperature of the fixing roller 29*b* when the pressing roller 29*c* is not in contact with the fixing roller 29*b*.

Thus, when the resin layer 131 of the fixing roller 29*b* contains moisture, that is, the temperature of the fixing roller 29*b* is lower than the evaporation temperature, according to the present embodiment, the pressing roller 29*c* is in contact with the fixing roller 29*b* to increase the heat capacity. As a result, the increase of the temperature of the fixing roller 29*b* can be made gradual, and the moisture contained in the resin layer 131 can evaporate slowly. As the moisture contained in the resin layer 131 evaporates slowly, the issue that bubbles are generated rapidly in the layer interface between the conductive layer 132 and the resin layer 131 and the peeling off at the layer interface of the fixing belt 29*d* are less likely to occur.

On the other hand, when the temperature of the fixing roller 29*b* is higher than the evaporation temperature (YES in ACT S2), the moisture contained in the resin layer 131 already started to evaporate, and probably most of the moisture has evaporated. In such a case, even if the fixing roller 29*b* is heated rapidly, the bubbles may not be generated rapidly in the layer interface; thus, it would not be necessary that the pressing roller 29*c* is in contact with the fixing roller 29*b* to increase the heat capacity before starting the heating of the fixing roller 29*b*. Thus, in the present embodiment, when the temperature of the fixing roller 29*b* is higher than the evaporation temperature, the fixing roller 29*b* is heated without moving the pressing roller 29*c* to be in contact with the fixing roller 29*b*.

If the pressing roller 29*c* is in contact with the fixing roller 29*b* in the warming up process, the heat capacity is larger, and therefore, more time is required for the warming up processing. Thus, when the temperature of the fixing roller 29*b* is higher than the evaporation temperature, for example, in a case of resuming after the jam processing, the pressing roller 29*c* is not in contact with the fixing roller 29*b*, which can reduce the time for the warming up processing.

According to the image forming apparatus of the embodiment described above, in a case of preheating the fixing device, the temperature of the fixing belt is detected; when the temperature of the fixing belt is lower than a temperature at which the moisture absorbed by the resin layer of the fixing belt evaporates, the pressing roller is moved to be in contact with the fixing belt and then the preheating processing is started. Thus, as the fixing belt may not be heated rapidly, the moisture between the resin layer and the conductive layer may not evaporates rapidly, and as a result the layers of the fixing belt may not be peeled off at the layer interface.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, in the embodiment described above, the pressing roller 29*c* is positioned at the semi-contact position so that the pressing roller 29*c* is in contact with the fixing roller 29*b*; however, the present invention is not limited to this. The pressing roller 29*c* may also be positioned at a position where the pressure from the pressing roller 29*c* is approximate to zero, and no limitation is given as long as the pressing roller 29*c* is at least in contact with the fixing roller 29*b*.

Further, in the present embodiment, when the temperature of the fixing roller 29*b* is lower than the evaporation temperature, the pressing roller 29*c* is in contact with the fixing roller 29*b* and then the fixing roller 29*b* is rotated and heated; however, the present invention is not limited to this. The processing in ACT S3-ACT S5 in FIG. 8 may be executed almost at the same time, and the execution order may also be changed.

What is claimed is:

1. A fixing apparatus comprising: a rotating member;

a fixing member including a lamination of a resin layer and a conductive layer, a sheet having an unfixed image being conveyed between the rotating member and the fixing member;

a heating unit configured to cause heating of the fixing member;

a support for one of the rotating member and the fixing member that is movable to change a positional state of the rotating member with respect to the fixing member, the positional state including a contact state in which the rotating member is in contact with the fixing member and a separate state in which the rotating member is apart from the fixing member;

a sensor configured to detect a temperature of the fixing member; and a controller configured to cause the fixing apparatus to transition from a non-fixing state to a fixing state by, if the detected temperature is lower than a first predetermined temperature, turning on the heating unit while the positional state is in the contact state, and if the detected temperature is higher than the first predetermined temperature, turning on the heating unit while the positional state is in the separate state and then controlling the support to change the positional state from the separate state to the contact state when the detected temperature reaches a second predetermined temperature that is higher than the first predetermined temperature.

2. The fixing apparatus according to claim 1, wherein the controller is further configured to control the rotating member to rotate in the contact state, if the detected temperature is lower than the first predetermined temperature.

3. The fixing apparatus according to claim 2, wherein, a pressure applied between the rotating member and the fixing member when the detected temperature is lower than the first predetermined temperature is smaller than the pressure applied when the detected temperature is higher than the second predetermined temperature.

4. The fixing apparatus according to claim 1, wherein the first predetermined temperature is an evaporation temperature of moisture contained in the resin layer.

5. A method for operating a fixing apparatus having a rotating member, a fixing member including a lamination of a resin layer and a conductive layer, and a heating unit configured to cause heating of the fixing member, the method being carried out to transition the fixing apparatus from a non-fixing state to a fixing state, the method comprising:

detecting a temperature of the fixing member;

if the detected temperature is lower than a first predetermined temperature, turning on the heating unit in a contact state in which the rotating member is in contact with the fixing member; and if the detected temperature is higher than the first predetermined temperature, turning on the heating unit in a separate state in which the rotating member is apart from the fixing member and then changing a positional state of the rotating member with respect to the fixing member from the separate state to the contact state when the detected temperature reaches a second predetermined temperature that is higher than the first predetermined temperature.

6. The method according to claim 5, further comprising:

controlling the rotating member to rotate in the contact state, if the detected temperature is lower than the first predetermined temperature.

7. The method according to claim 6, wherein a pressure applied between the rotating member and the fixing member when the detected temperature is lower than the first predetermined temperature is smaller than the pressure applied when the detected temperature is higher than the second predetermined temperature.

8. The method according to claim 5, wherein the first predetermined temperature is an evaporation temperature of moisture contained in the resin layer.

9. An image forming apparatus comprising:

an image forming section configured to form an unfixed image on a sheet;

a fixing section configured to fix the unfixed image onto the sheet; and a sheet conveying section configured to convey the sheet from the image forming section to the fixing section, the fixing section including forming A fixing apparatus comprising: a rotating member;

a fixing member including a lamination of a resin layer and a conductive layer, a heating unit configured to cause heating of the fixing member, a support for one of the rotating member and the fixing member that is movable to change a positional state of the rotating member with respect to the fixing member, the positional state including a contact state in which the rotating member is in contact with the fixing member and a separate state in which the rotating member is apart from the fixing member;

a sensor configured to detect a temperature of the fixing member; and a controller configured to cause the fixing apparatus to transition from a non-fixing state to a fixing state by, if the detected temperature is lower than a first predetermined temperature, turning on the heating unit while the positional state is in the contact state, and if the detected temperature is higher than the first predetermined temperature, turning on the heating unit while the positional state is in the separate state and then controlling the support to change the positional state from the separate state to the contact state when the detected temperature reaches a second predetermined temperature that is higher than the first predetermined temperature.

10. The image forming apparatus according to claim 9, wherein the controller is further configured to control the rotating member to rotate in the contact state, if the detected temperature is lower than the first predetermined temperature.

11. The image forming apparatus according to claim 10, wherein a pressure applied between the rotating member and the fixing member when the detected temperature is lower than the first predetermined temperature is smaller than the pressure applied when the detected temperature is higher than the second predetermined temperature.

12. The image forming apparatus according to claim 9, wherein the first predetermined temperature is an evaporation temperature of moisture contained in the resin layer.

* * * * *